US006829902B1

(12) United States Patent
Claydon

(10) Patent No.: US 6,829,902 B1
(45) Date of Patent: Dec. 14, 2004

(54) SELF-COOLING CAN

(75) Inventor: Paul Charles Claydon, Wantage (GB)

(73) Assignee: Crown Cork & Seal Technologies Company, Alsip, IL (US)

( * ) Notice: Subject to any disclaimer, the term of this patent is extended or adjusted under 35 U.S.C. 154(b) by 115 days.

(21) Appl. No.: 10/048,308

(22) PCT Filed: Aug. 2, 2000

(86) PCT No.: PCT/GB00/02983

§ 371 (c)(1),
(2), (4) Date: Jan. 29, 2002

(87) PCT Pub. No.: WO01/10738

PCT Pub. Date: Feb. 15, 2001

(30) Foreign Application Priority Data

Aug. 4, 1999 (GB) ..... 9918318
Nov. 30, 1999 (GB) ..... 9928153

(51) Int. Cl.[7] ..... B65B 63/08

(52) U.S. Cl. ..... 62/60; 62/294; 62/293; 62/4; 62/101; 62/488; 62/477

(58) Field of Search ..... 62/244, 293, 4, 62/60, 101, 488, 477

(56) References Cited

U.S. PATENT DOCUMENTS

| | | | | |
|---|---|---|---|---|
| 3,970,068 A | | 7/1976 | Sato | 126/263 |
| 4,669,273 A | | 6/1987 | Fischer et al. | 62/294 |
| 4,736,599 A | | 4/1988 | Siegel | 62/294 |
| 4,759,191 A | | 7/1988 | Thomas et al. | 62/101 |
| 4,901,535 A | | 2/1990 | Sabin et al. | 62/101 |
| 4,911,740 A | * | 3/1990 | Schieder | 62/4 |
| 4,928,495 A | | 5/1990 | Siegel | 62/4 |
| 4,949,549 A | | 8/1990 | Steidl et al. | 62/101 |
| 4,974,419 A | * | 12/1990 | Sabin et al. | 62/101 |
| 4,993,239 A | | 2/1991 | Steidl et al. | 62/480 |
| 5,018,368 A | | 5/1991 | Steidl et al. | 62/480 |
| 5,048,301 A | * | 9/1991 | Sabin et al. | 62/101 |
| 5,079,932 A | * | 1/1992 | Siegel | 62/293 |
| 5,168,708 A | | 12/1992 | Siegel | 62/4 |
| 5,197,302 A | | 3/1993 | Sabin et al. | 62/477 |
| 5,230,216 A | * | 7/1993 | Siegel | 62/4 |
| 5,233,836 A | * | 8/1993 | Siegel | 62/4 |
| 5,313,799 A | * | 5/1994 | Siegel | 62/4 |
| 5,331,817 A | * | 7/1994 | Anthony | 62/5 |
| 5,447,039 A | | 9/1995 | Allison | 62/293 |
| 5,655,384 A | * | 8/1997 | Joslin, Jr. | 62/294 |
| 6,103,280 A | * | 8/2000 | Molzahn et al. | 426/109 |
| 6,141,970 A | * | 11/2000 | Molzahn et al. | 62/4 |
| 6,151,911 A | * | 11/2000 | Dando et al. | 62/457.3 |

FOREIGN PATENT DOCUMENTS

| | | |
|---|---|---|
| EP | 0 752 564 A2 A3 | 1/1997 |
| GB | 2 329 461 | 3/1999 |
| WO | WO 91/05976 | 5/1991 |
| WO | WO 99/37958 | 7/1999 |
| WO | WO 01/111297 | 2/2001 |

OTHER PUBLICATIONS

Copy of the as filed U.S. patent application No. 10/048,321, filed Jan. 29, 2002 (WO 01/11297 A1).
Allowed claims in U.S. patent application No. 10/048,321.

* cited by examiner

*Primary Examiner*—William C. Doerrler
*Assistant Examiner*—Mark S. Shulman
(74) *Attorney, Agent, or Firm*—Woodcock Washburn LLP

(57) ABSTRACT

A self-cooling can (10) which is suitable for cooling 300 ml of beverage by 30° F. in a maximum of 3 minutes comprises an internal evaporator (30) and an absorber unit (20) which is fixed typically to the base of the can. Cooling is initiated by providing a vapour path from the evaporator (30) to a desiccant region of the absorber unit (20). Heat is removed from the vapour and/or any heat due to the reaction with the desiccant (24) by heat sink material (26) around the desiccant region (22).

24 Claims, 4 Drawing Sheets

SELF-COOLING CAN

This invention relates to a self-cooling can. In particular, it relates to a can suitable for containing beverage which includes a refrigeration device within and/or attached to the can so that cooling may be initiated at any time and anywhere, remote from a domestic/commercial refrigerator.

The principles of refrigeration are well-established, using refrigerant in an evaporator to extract heat from the refrigeration compartment (or freezer compartment, as applicable) and then releasing heat from the refrigerant by means of a compressor and condenser or, alternatively, in an absorber.

There are a number of problems associated with adapting known refrigerating units for cooling a beverage in a can. Since the can is to be self-cooling, the refrigeration device needs to be contained in or surround the can. A typical beverage can has, for example, a capacity of 330 ml and tooling, filling and handling equipment is adapted for this size of can. It is clear, therefore, that any internal refrigeration device will either necessitate an increase in can size, with associated equipment changes, or a decrease in the volume of beverage which the can holds.

A further problem is the time taken to cool the volume of liquid to a desired drinking temperature. The flow of liquid/vapour through a miniature refrigeration device and the choice of refrigerant may be limiting factors in this. Clearly a non-toxic refrigerant is at least desirable and possibly essential for use with beverage.

Finally, initiation of the cooling process should ideally be a simple procedure for the consumer to carry out.

U.S. Pat. No. 4,669,273 describes a self-cooling beverage container which uses a coiled tube within the beverage can which releases a pressurised refrigerant to an evaporator for cooling the beverage. Not only does this device severely limit the capacity of the can available for the beverage but there is also a safety issue involved in the use of a pressurised refrigerant within the can.

Phase change cooling devices are described in U.S. Pat. No. 4,759,191, U.S. Pat. No. 4,901,535, U.S. Pat. No. 4,949,549, U.S. Pat. No. 4,993,239 and U.S. Pat. No. 5,197,302, for example. Such devices typically have an evaporator chamber and an evacuated absorber chamber. Liquid such as water in the evaporator vaporises due to a drop in pressure when a valve between the two chambers is opened and therefore removes heat from the evaporator to do so. Latent heat of vaporisation is then absorbed by heat removing material in the absorber chamber. U.S. Pat. No. 5,018,368 uses a desiccant/heat sink device for absorbing water vapour from the evaporator.

These phase change materials are generally not preferred for cooling a product with a can due to the loss of can capacity available for the product itself. Furthermore the length of time taken to cool the can of beverage is often unacceptable for practical purposes. There is a general need for improved can cooling devices and methods.

According to the present invention, there is provided a self cooling can comprising: a cylindrical can body for beverage product; an evaporator within the can body for removing heat from beverage product surrounding the evaporator, the evaporator comprising an annular component having an inner and outer wall with a gap between the walls, the curled edge of the outer wall being clipped onto a ridge on the inside chine wall of the base of the can body to form a sealed unit which holds a high vacuum and is isolated from beverage product; an absorber unit fixed to the outside of the can body and including a first desiccant region and a second region containing heat sink material, either the desiccant region or the second region of the absorber unit comprising an absorber element having one or more pockets for the desiccant or heat sink material respectively; and means for providing a vapour path from the evaporator to the absorber unit such that, in use, when the vapour path is opened, vapour passes from the evaporator to the desiccant region of the absorber unit, the vapour being absorbed by the desiccant and heat from the vapour and/or the reaction of the desiccant being removed by the heat sink material, thereby cooling product around the evaporator.

By using an absorber which is external to the can, only the evaporator will reduce the can capacity available for the product.

By separating the absorber from the evaporator, any risk that heat removed by the absorber offsets or even negates the cooling effect of the evaporator is avoided. The use of an evaporator and external absorber unit means that the product is entirely isolated from the cooling system and from direct contact with cooling material.

The product, which is usually a beverage, is thus cooled by means of vapour which passes from the evaporator to the absorber when the evaporator and absorber are connected such that a vapour path is formed by the connection. Cooling is thus achieved by natural convection due to the evaporator being at a lower temperature than the product. Where the evaporator includes water in the form of a water-based gel coating, for example, then a vacuum or a low pressure within the evaporator and absorber is required to ensure that evaporation occurs at relatively low temperature and to optimise the rate at which cooling occurs. Ideally, the rate of cooling is 30° F. in a maximum of 3 minutes for 300 ml of beverage.

Preferably, either the desiccant region or the second region of the absorber unit comprises an absorber element having one or more pockets for the desiccant or heat sink material respectively.

In one embodiment, the absorber element is a metal container comprising one or more annuli such that these annuli form one or more desiccant pockets. One possible method of manufacturing the absorber and/or evaporator elements is by multiply redrawing metal. Preferably, the metal container and annuli thereof are surrounded by heat sink material.

In an alternative embodiment, the absorber element comprises one or more pouches, each divided into one or more pockets filled with heat sink material. Where a single pouch is used, it may comprise a corrugated strip of heat sealed foil or laminate of film and foil which may be coiled within the absorber unit in order to provide maximum cooling surface. In this embodiment, voids between the pockets may be filled with desiccant.

Usually, the absorber is connectable to the base of the can body. This connection preferably comprises a valve connected to the evaporator and a rupturable seal on the absorber unit such that the absorber unit plugs into the valve housing. Alternative connectors/actuation methods are described in copending patent application WO/GB00/02986 which is incorporated herein by reference.

According to a further aspect of the present invention, there is provided a method of cooling a beverage product in a can body, the method comprising: beading the upper end of a metal container and reverse redrawing said beaded container to form an evaporator element having an outer wall (34) formed from the upper end of the metal container and an inner wall (32) formed from the lower end of the metal container, said inner and outer walls being spaced by a gap; inserting the evaporator element into the can body and fixing the evaporator in the can body by clipping the curled edge (36) of the evaporator onto a ridge on the inside chine wall of the base of the can body to form a sealed unit which holds a high vacuum and is isolated from beverage product; fixing an absorber unit to the outside of the can body; evaporating liquid in the evaporator and providing a vapour path from the evaporator to a desiccant region of the absorber unit; absorbing moisture from the vapour by reaction between the desiccant and the vapour; and removing heat from the vapour and/or reaction of the desiccant, thereby cooling beverage product surrounding the evaporator.

Preferred embodiments of the invention will now be described, with reference to the drawings, in which.

Figure 1:
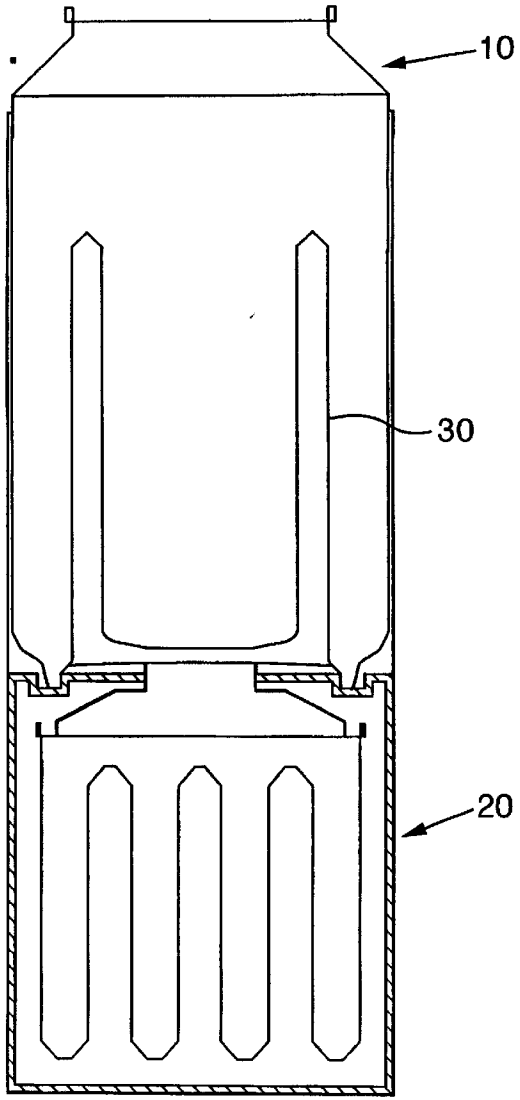
FIG. 1 is a side section of a self-cooling can assembly according to a first embodiment of the invention.

FIG. 1 shows a first embodiment of self cooling can comprising a can body 10, absorber unit 20 and evaporator 30. The can body has a volume of around 380 ml so as to contain 300 ml of product.

Figure 2:
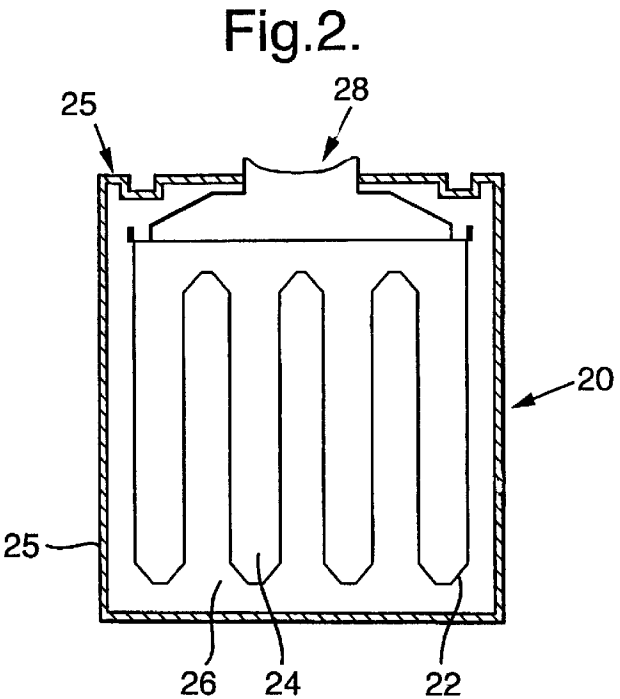
FIG. 2 is a side section of an absorber for the can of FIG. 1.

FIG. 2 shows the absorber unit 20 which comprises a multiple reverse redrawn container 22 which is formed in typically seven stages from uncoated 0.16 mm tinplate. Uncoated tinplate avoids the possibility of outgassing from internal protection which might compromise internal vacuum. Container 22 holds desiccant 24 and is, in turn, placed within a plastic moulded container 25. Container 25 is filled with phase change acetate heat sink material 26.

Figure 4:
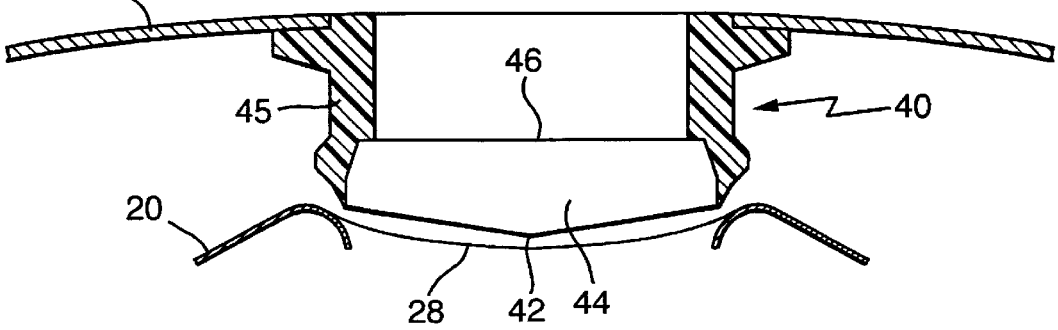
FIG. 4 is an activation device for the assembly of FIG. 1.

Desiccant container 22 container 22 comprises concentric annuli which form pockets for filling with approximately 70 to 130 ml of desiccant 24 so as to ensure a large area of contact with surrounding heat sink material 26. Desiccant container 22 may be vacuum seamed to a very high vacuum level and closed by heat sealing a frangible foil diaphragm 28, alternatively the vacuum may be pulled during heat sealing. Heat sink acetate material 26 is poured into the insulating container 25 from the base, prior to closing by ultrasonic welding. The insulating container is preferable to allow a consumer to handle the absorber unit which would otherwise become hot during the cooling of the beverage. Moulded features of insulating container 25 include an attachment and engagement device for activating the absorber unit when the valve assembly (FIG. 4) penetrates foil seal 28.

Evaporator element 30 (FIG. 3) comprises an annular reverse redrawn component formed from steel or aluminum. Usually the upper end of this element is beaded prior to reverse drawing. The beading increases the strength of the element and makes it possible to use thinner materials. Beading also improves handling and assembly of the component. The beaded evaporator is then coated with lacquer or a polymer such as PET, and has a finished height of 100 mm and diameter of 50 mm. A height of 100 mm places the top of the evaporator approximately 10 mm below the surface of the liquid and is considered to be the minimum necessary to give the optimum cooling surface. The diameter is selected so as to pass through the neck of a 202 diameter can. The gap between the inner and outer walls 32, 34 is kept to a minimum to avoid loss of can volume available for product such as beverage. The inner surface of the evaporator annulus is coated with a film of water-based gel 35. An actuation valve (FIG. 4) is fitted to an aperture pierced in the dome 14 of can 10. Alternative designs of actuation device are described in copending patent application no. WO/GB00/02986.

Figure 3:
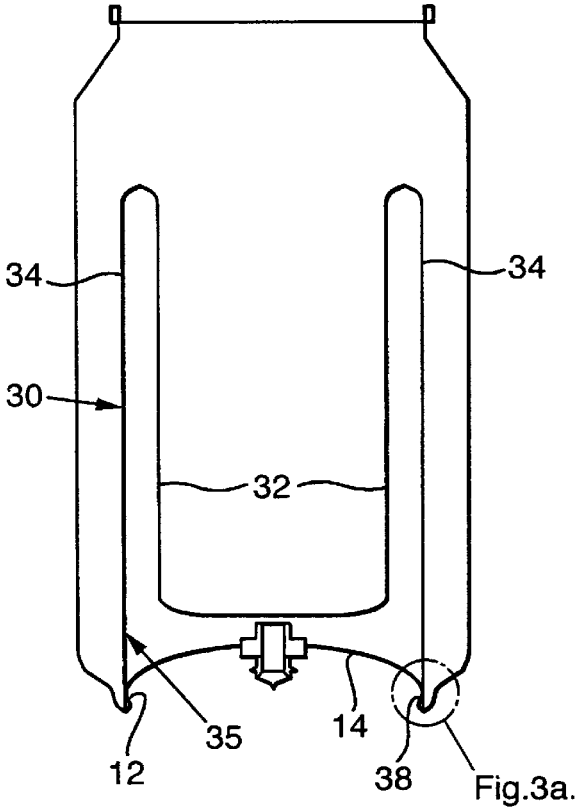
FIG. 3 is a side section of the can of FIG. 1, fitted with an evaporator element.
Figure 3A:
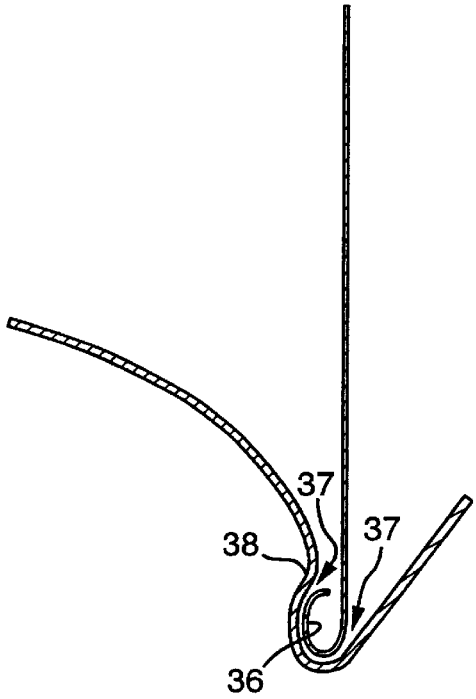

As shown in the detail of FIG. 3*a*, the evaporator element is sealed and clipped into the stand bead 12 of can 10, under a formed ridge in the inside chine wall. The edge of the evaporator element 32 is curled 36 and beverage-approved water-based sealing compound 37 is provided on the inside of the base of the can body between the stand bead of the can and the curl to ensure an hermetic seal. Curl 36 can either be snap fitted and sealed over a ridge 38 which is formed by internal base reform, or the evaporator may be secured in position by post-reforming the ridge feature 38 around the evaporator curl. This ensures that the evaporator maintains a high vacuum (necessary to achieve the desired cooling rate for the chilling process) and that the pressure of the beverage will not compromise the seal.

Gel is applied to the evaporator internal surface by flooding with a suspension of the powder in methanol, pouring off the excess and then evaporating the remaining methanol. The dry film is then hydrated by flooding with water and, again, pouring off the excess. A gel film of approximately 0.5 mm is used to carry 10–12 ml of water for cooling the 300 ml of beverage.

In use, the absorber unit 20 is pushed together with the can/evaporator. A two piece valve assembly 40 such as that of FIGS. 4 and 5 may be used to displace any trapped air and then seal in the aperture of the foil closed desiccant chamber prior to breaking through the foil 28 with valve apex 42. Valve 40 comprises a stem 45 of compressible material such as neoprene/nitrile and a valve apex 42. Upper end of the stem 45 is covered with a gas barrier layer 46. A ridge in the valve body ensures that further penetration will result in compressing the stem 45 of the valve just behind the plug 44, thereby opening the vapour path. The insulating container 25 of the absorber unit engages with the can dome resulting in a positive snap fit of the absorber and evaporator units.

Figure 6A:
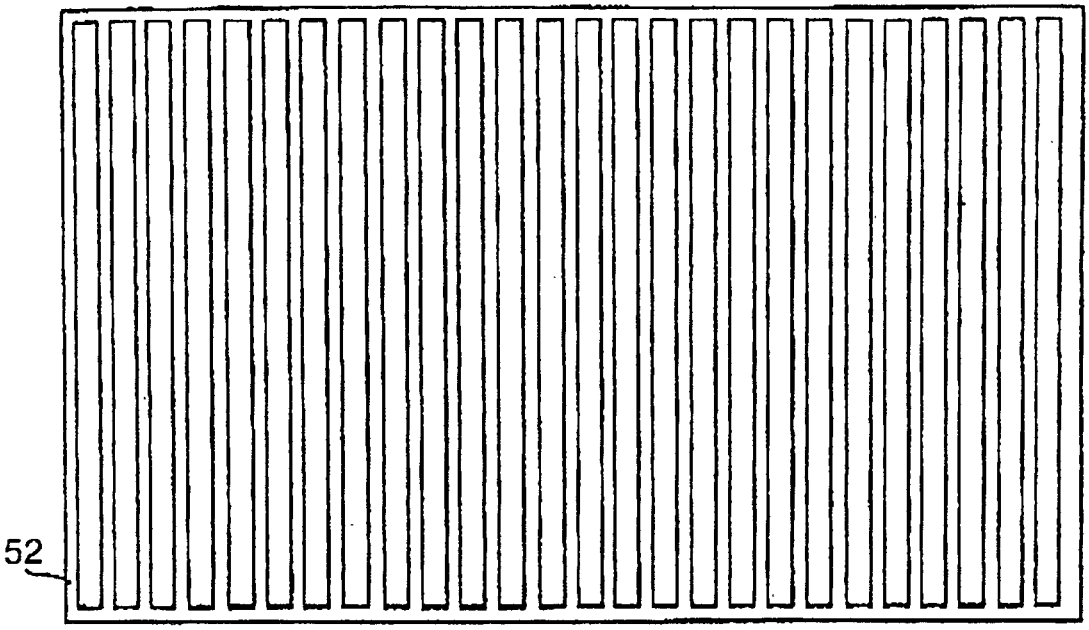
FIG. 6 is a partial side section of a second embodiment of absorber.
Figure 6B:
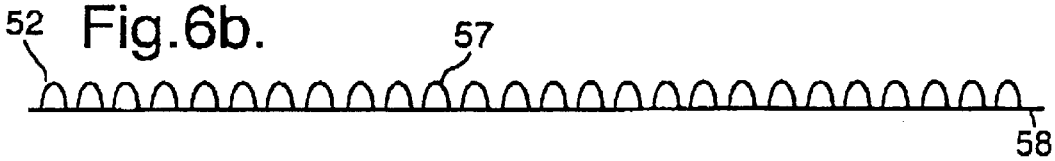
Figure 6C:
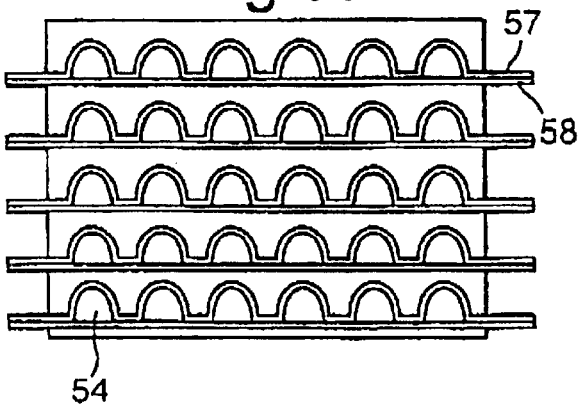
Figure 6D:
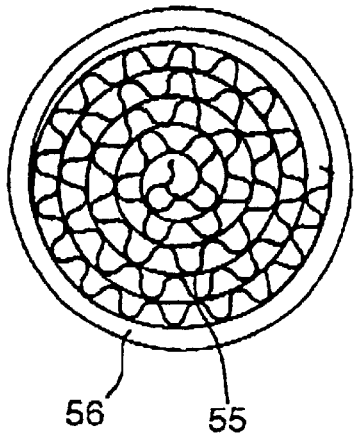

FIGS. 6*a* to 6*d* show a second embodiment of absorber unit 50 for a self-cooling can. The absorber unit 50 includes a continuous corrugated strip 52 of aluminum foil. The corrugated layer 57 of strip 52 is heat sealed between its corrugations to a second layer 58 to form a series of pockets 54. The ends of the strip are also sealed, for example by heat sealing. As shown in FIG. 6*b*, the corrugated side 57 is a thin film of material, typically aluminum foil. Lower side 58, again as depicted in FIG. 6*b*, may be foil.

Aluminum foil is the preferred material as this has the necessary barrier properties which are required for the high vacuum levels involved. The foils used are coated with heat-sealable lacquers on one side only, as out-gassing from the lacquer will also compromise the high vacuum.

The pockets 54 are filled with heat sink material such as acetate and the strip is coiled (FIG. 6*d*) so as to fit in an insulating jacket 56 within the heat absorber container 20. Once coiled and in position in the absorber, desiccant is poured into the absorber to fill voids between the pockets and around the coil 55.

In an alternative arrangment, instead of the single coiled strip filled with acetate, individual pouches containing heat sink material may be used. The pouches are surrounded by desiccant as before.

Opening of a vapour path from the evaporator to the absorber unit enables vapour to contact desiccant initially around the coil 55 (or individual pouches) and thereafter to penetrate into the desiccant-filled voids between the pockets of heat sink material. A typical ratio of desiccant to heat sink material which is required is 50:50 by volume.

Figure 5:
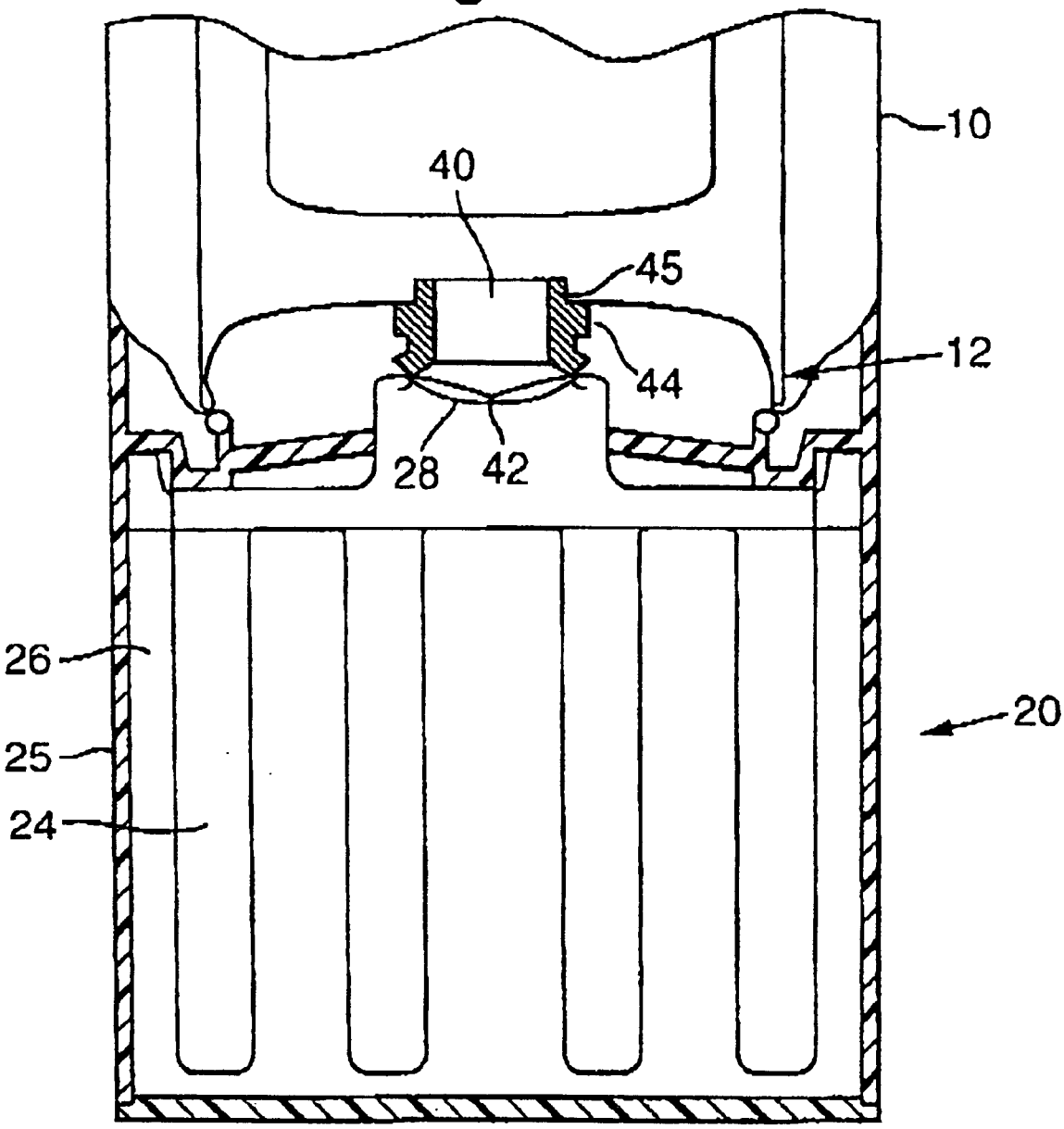
FIG. 5 is a partial side section of the assembly of FIG. 1 showing the activation device of FIG. 4 when assembled.

The absorber unit of FIG. 6 may ideally be used as an external absorber unit in conjunction with the evaporator of FIG. 3 to replace the absorber unit of FIGS. 1, 2 and 5.

What is claimed is:

1. A self cooling can comprising:

a cylindrical can body for beverage product;

an evaporator within the can body for removing heat from beverage product surrounding the evaporator, the evaporator comprising an annular component having an inner and outer wall with a gap between the walls, the curled edge of the outer wall being clipped onto a ridge on the inside chine wall of the base of the can body to form a sealed unit which holds a high vacuum and is isolated from beverage product;

an absorber unit fixed to the outside of the can body and including a first desiccant region and a second region containing heat sink material, either the desiccant region or the second region of the absorber unit comprising an absorber element having one or more pockets for the desiccant or heat sink material respectively; and means for providing a vapor path from the evaporator to the absorber unit such that, in use, when the vapor path is opened, vapor passes from the evaporator to the desiccant region of the absorber unit, the vapor being absorbed by the desiccant and heat from the vapor and/or the reaction of the desiccant being removed by the heat sink material, thereby cooling product around the evaporator.

2. A can according to claim 1, in which the absorber element is a metal container comprising one or more annuli which form the one or more desiccant pockets.

3. A can according to claim 2, in which the absorber element is formed by multiply redrawing metal.

4. A can according to claim 3, in which the metal container and annuli thereof are surrounded by heat sink material.

5. A can according to claim 1, in which the absorber element comprises one or more pouches, each divided into one or more pockets filled with heat sink material.

6. A can according to claim 5, in which the pouch comprises a corrugated strip of heat sealed foil or laminate film.

7. A can according to claim 6, in which the pouch is coiled within the absorber unit, in order to provide maximum cooling surface.

8. A can according to claim 6, in which voids between the pockets are filled with desiccant.

9. A can according to claim 7, in which voids between the pockets are filled with desiccant.

10. A can according to claim 5, in which voids between the pockets are filled with desiccant.

11. A can, comprising:

a body portion for holding a beverage product;

an evaporator located within the body portion and filled with a vapor; and an absorber unit located external to the body portion, the absorber unit comprising a first portion having a heat sink material therein, and a second portion having a desiccant material therein, wherein the absorber unit is coupled to the evaporator so that the evaporator and the absorber unit are in fluid communication on a selective basis, and the vapor flows from the evaporator to the absorber unit and is absorbed by the desiccant when the evaporator and the absorber unit are in fluid communication.

12. A method of cooling a beverage product in a can body, the method comprising:

beading the upper end of a metal container and reverse redrawing said beaded container to form an evaporator element having an outer wall and an inner wall, said inner and outer walls being spaced by a gap;

inserting the evaporator element into the can body and fixing the evaporator in the can body by clipping the curled edge of the evaporator onto a ridge on the inside chine wall of the base of the can body to form a sealed unit which holds a high vacuum and is isolated from beverage product;

fixing an absorber unit to the outside of the can body;

evaporating liquid in the evaporator and providing a vapor path from the evaporator to a desiccant region of the absorber unit;

absorbing moisture from the vapor by reaction between the desiccant and the vapor; and removing heat from the vapor and/or reaction of the desiccant, thereby cooling beverage product surrounding the evaporator.

13. A can, comprising:

a body portion for holding beverage product;

an evaporator located within the body portion and filled with a vapor; and an absorber unit located external to the body portion, the absorber unit comprising a first portion having a heat sink material therein, and a second portion having a desiccant material therein, wherein the absorber unit is coupled to the evaporator so that the evaporator and the absorber unit are in fluid communication on a selective basis, and the vapor flows from the evaporator to the absorber unit and is absorbed by the desiccant when the evaporator and the absorber unit are in fluid communication.

14. A can according to claim 13, in which the absorber unit includes an absorber element that has one or more pockets.

15. A can according to claim 14, in which the desiccant or the heat sink material is disposed in the pockets.

16. A can according to claim 14, in which the absorber element is a metal container comprising one or more annuli.

17. A can according to claim 16, in which the desiccant is disposed in the annuli.

18. A can according to claim 16, in which the absorber element is formed by multiply redrawing metal.

19. A can according to claim 16, in which the metal container and annuli thereof are surrounded by the heat sink material.

20. A can according to claim 14, in which the absorber element comprises one or more pouches, each divided into one or more pockets filled with heat sink material.

21. A can according to claim 20, in which the pouch comprises a corrugated strip of heat sealed foil or laminate film.

22. A can according to claim 21, in which the pouch is coiled within the absorber unit, in order to provide maximum cooling surface.

23. A can according to claim 20, in which voids between the pockets are filled with desiccant.

24. A can according to claim 15, in which the absorber unit is fixed to the can body by heat shrink, glue or mechanical engagement.

* * * * *